US011700925B2

(12) United States Patent
Lederer

(10) Patent No.: US 11,700,925 B2
(45) Date of Patent: Jul. 18, 2023

(54) CONNECTABLE SUITCASE

(71) Applicant: RTL Group Investments Pty Ltd, Bellevue Hill (AU)

(72) Inventor: Robert Lederer, Bellevue Hill (AU)

(73) Assignee: RTL GROUP INVESTMENTS PTY LTD, Bellevue Hill (AU)

( * ) Notice: Subject to any disclaimer, the term of this patent is extended or adjusted under 35 U.S.C. 154(b) by 111 days.

(21) Appl. No.: 16/633,050

(22) PCT Filed: Aug. 2, 2018

(86) PCT No.: PCT/AU2018/000127
§ 371 (c)(1),
(2) Date: Jan. 22, 2020

(87) PCT Pub. No.: WO2019/023736
PCT Pub. Date: Feb. 7, 2019

(65) Prior Publication Data

US 2020/0205533 A1 Jul. 2, 2020

(30) Foreign Application Priority Data

Aug. 2, 2017 (AU) ..... 2017903057

(51) Int. Cl.
*A45C 7/00* (2006.01)
*A45C 5/14* (2006.01)
(Continued)

(52) U.S. Cl.
CPC ..... *A45C 7/0045* (2013.01); *A45C 5/14* (2013.01); *A45C 13/1069* (2013.01);
(Continued)

(58) Field of Classification Search
CPC ..... A45C 7/0045; A45C 5/14; A45C 13/1069; A45C 13/262; A45C 2013/265; A45C 2013/267; A45C 13/36
(Continued)

(56) References Cited

U.S. PATENT DOCUMENTS 5,099,968 A 3/1992 Kikuchi
2008/0308369 A1* 12/2008 Louis ..... A45C 5/14 190/108
(Continued)

FOREIGN PATENT DOCUMENTS

CN 105163998 12/2015
WO WO 2015/196238 12/2015

OTHER PUBLICATIONS

European Search Report for Corresponding Application No. EP 18 84 0731 , dated Mar. 2, 2021, 7 pages.
(Continued)

*Primary Examiner* — John K Fristoe, Jr.
*Assistant Examiner* — Jessica Kavini Tamil
(74) *Attorney, Agent, or Firm* — Dority & Manning, P.A.

(57) ABSTRACT

A suitcase connectable to another suitcase includes: a first connecting portion disposed on a front surface of the suitcase, and a second connecting portion disposed on a rear surface of the suitcase. The first connecting portion is operatively associated with the second connecting portion to connect at least two suitcases front to rear. The suitcase further includes a front pair of wheels mounted along a first axis, and a rear pair of wheels mounted along a second axis parallel to the first axis, wherein the front pair of wheels is spaced apart laterally a first distance, and the rear pair of wheels is spaced apart laterally a second distance larger than the first distance, so that when the at least two suitcases are connected front to rear, the front pair of wheels of the rear
(Continued)

suitcase nest between the rear pair of wheels of the front suitcase.

8 Claims, 12 Drawing Sheets

(51) Int. Cl.
*A45C 13/10* (2006.01)
*A45C 13/26* (2006.01)

(52) U.S. Cl.
CPC ..... *A45C 13/262* (2013.01); *A45C 2013/265* (2013.01); *A45C 2013/267* (2013.01)

(58) Field of Classification Search
USPC ..... 190/108
See application file for complete search history.

(56) References Cited

U.S. PATENT DOCUMENTS

2008/0308370 A1 12/2008 Chung et al.
2009/0057082 A1 3/2009 Mize
2011/0247910 A1* 10/2011 Darvish ..... A45C 13/385 190/18 A
2012/0124786 A1* 5/2012 Fiedler ..... A45C 13/1069 24/303
2013/0175129 A1 7/2013 Rankin et al.
2015/0014949 A1 1/2015 Dittman
2015/0114777 A1* 4/2015 Edme ..... A45C 13/262 190/18 A

OTHER PUBLICATIONS

International Search Report for PCT/AU2018/000127 dated Sep. 20, 2018, 3 pages.
Chinese Second Office Action (w/ partial English translation) for corresponding Chinese Application No. 2018800500969, dated Jan. 13, 2022, 9 pages.
Chinese Third Office Action for corresponding Chinese Application No. 2018800500969, 4 pages.
European Search Report for corresponding European Application No. 18 840 731.6, dated Jan. 24, 2022, 5 pages.
Indonesian Office Action for corresponding Indonesian Application No. P00202001031, dated Aug. 25, 2021, 4 pages.
Japanese Office Action for corresponding Japanese Application No. 2020-528496, dated Jan. 25, 2022, 4 pages.
Canadian Search Report for corresponding Canadian Application No. 3,070,218, date Nov. 9, 2022, 3 pages.

* cited by examiner

CONNECTABLE SUITCASE

PRIORITY CLAIM

This application is based upon and claims the right of priority under 35 U.S.C. § 371 to International Application No. PCT/AU2018/000127 filed on Aug. 2, 2018, which claims priority to AU 2017903057 filed on Aug. 2, 2017, each of which is incorporated by reference herein in its entirety.

FIELD

The present invention relates to a connectable suitcase, and in particular a suitcase connectable to other suitcases.

BACKGROUND

Items of luggage such as suitcases are generally transported by either lifting, pushing or pulling the suitcase on a set of wheels or stacking multiple suitcases on a luggage trolley. However, whichever method the luggage items are to be transported, the items are handled as individual units. This makes it difficult to transport two suitcases or more in an environment in which no luggage trolley is available. If a luggage trolley is available, such as in an airport environment, it is often necessary to leave the items of luggage to one side in order to find a trolley. The trolley is typically coin operated and it can be difficult to lift and balance multiple luggage items on the trolley for transportation. Doing so can require some physical effort and can result in a user straining his or her back. Using a trolley to transport multiple items of luggage can therefore be inconvenient, costly and potentially dangerous, particularly for a single user.

In the past, users of multiple luggage items have addressed some of the above issues by binding the luggage items together using strapping or rope to make them more easily transportable as a unit. However, this method invariably results in the strapping or string coming loose or riding up and down the luggage items, such that transporting the items on a trolley over any bumps can cause them to come apart. It also requires some time and effort to bind multiple luggage items together.

OBJECTION OF THE INVENTION

It is the object of the present invention to substantially overcome or at least ameliorate one or more of the above disadvantages.

SUMMARY OF THE INVENTION

There is disclosed herein a suitcase connectable to other like suitcases for easy transport. The suitcase includes a front set of wheels and a rear set of wheels to enable a user to roll the suitcase during transport. Each wheel in the front set of wheels is indented toward center so that the wheels sit on axes offset from the rear wheels. The suitcase includes a front surface and a rear surface arranged in spaced relation with the front surface. A first connection portion of a two-part connector is arranged on the front surface of the suitcase, and a second connection portion of the two-part connector is arranged on the rear surface of the suitcase. The connection portions are magnetic and attract to lock together.

An advantage of the above unit is that multiple suitcases can be quickly and easily locked together for transportation as a single unit.

The wheel configuration enables the front wheels of a rear suitcase to nest between the rear wheels of a forward suitcase when two or more suitcases are connected together. This allows for smooth movement of the suitcase along the ground. The suitcases can therefore be connected together and transported without the need for lifting or the use of a trolley.

Preferably, the suitcase has an upper surface and a retractable handle mechanism. The retractable handle mechanism includes a handle having a pair of telescopic arms and a gripping portion connecting the pair of telescopic arms. More preferably, the gripping portion spans a lateral dimension of the suitcase. Preferably, the telescopic arms include a pivotable hinge at a base thereof for pivotal movement of the retractable handle. Preferably, the retractable handle mechanism is tiltable away from the suitcase.

Preferably, the first connection portion of the magnetic connector comprises a housing having two closure modules. Each closure module includes an end wall at a proximal end thereof, at least one magnet arranged inside the housing, an endcap attached to the housing at a distal end thereof, and a resilient biasing means arranged over the housing between the end wall and the endcap. The second connection portion of the magnetic connector includes a housing having two complementary closure modules. Each closure module having at least one magnet arranged inside the housing, whereby in use of the magnetic connector, the resilient biasing means is adapted to bias the housing and end wall of the first part in a first retracted position relative to the second connecting portion when the first connection portion and second connection portion are unconnected and, as the first connection portion and the second connection portion are connected together, to contract under a magnetic force emitted by the second connection portion to cause the housing and end wall of the first part to move to a second extended position relative to the second part for engagement therewith.

Preferably, the first connection portion of the magnetic connector is installed in the front surface of the unit such that the front plate lies on the front surface of the unit and the end wall lies flush with the front surface in the retracted position thereof.

Preferably, the endcap of the first connection portion includes a second connection portion engagement portion and the housing of the second connection portion includes a first connection portion engagement portion for engaging the second part engagement portion of the first part.

Preferably, the second part engagement portion of the first part is a male component and the first part engagement portion is a female component.

Preferably, the second part of the magnetic connector is installed in the rear surface of the unit such that the female engagement portion protrudes therefrom.

Preferably, the second part engagement portion of the first part comprises a peripheral flange of the end wall.

Preferably, the first part engagement portion of the second part comprises at least one resilient member. More preferably, the first part engagement portion comprises a plurality of the resilient members spaced from one another around a portion of a sidewall of the housing, the plurality of resilient members together subtending an angle of no more than about 270 degrees.

Preferably, the endcap further includes a housing engagement member that extends away from the endcap.

Preferably, the housing of the first part has a sidewall with an aperture therein for receiving the housing engagement member of the endcap.

Preferably, a distal end of the housing engagement member is arranged to abut the magnet inside the housing of the first part.

Preferably, the distal end of the housing engagement member comprises a cam surface, the cam surface terminating in a rebate at a distance away from the distal end so as to form a lug. More preferably, the lug is engageable in the aperture of the sidewall of the housing.

Preferably, the first part includes a face plate having a central aperture therein, the face plate being arranged to fit over the housing sidewall in abutment with the peripheral flange of the end wall.

Preferably, the housing of the second part includes a sidewall and the magnet is arranged within the sidewall. Preferably, the housing further includes an endcap arranged over the housing to retain the magnet inside the housing.

Preferably, the resilient biasing means is a helical spring. More preferably, the helical spring is made of spring steel.

Preferably, the housing and endcap of the first part and the housing and endcap of the second part are made of plastic, more preferably nylon.

According to a second aspect, there is provided herein a modular unit system, comprising a plurality of units in accordance with the first aspect.

Preferably, the plurality of units comprises at least a first unit and a second unit and the position of the first part of the two-part connector on the front surface of the first unit and the position of the second part of the two-part connector on the rear surface of the second connector lie on an axis that passes through each of the first and second unit when the units are placed adjacent one another. Preferably, where the front surface of the first unit includes two of the first parts spaced from one another and the rear surface of the second unit includes two of the second parts spaced from one another, correspondingly spaced first parts and second parts lie along respective first and second axes that are laterally spaced from one another and which pass through each of the first and second units when the units placed adjacent one another.

There is further disclosed herein a method of locking together a first unit and a second unit of a modular unit system, the first and second units each having a front surface and a rear surface, each front surface having an aperture therein and at least one first part of a magnetic connector embedded in the aperture, each rear surface having an aperture therein and at least one second part of a magnetic connector embedded in the aperture, the method comprising the steps of: placing the first unit adjacent the second unit such that the front surface of the first unit is adjacent the rear surface of the second unit, and the first part of one magnetic connector is adjacent a second part of a magnetic connector, so as to cause the resilient biasing means of the first part to contract under the magnetic force of the magnet of the second part, thereby placing the first part in an extended position relative to the second part whereby the male engagement portion of the first part locks into the female engagement part of the second part, thereby locking the units together.

There is still further disclosed herein a magnetic connector for connecting together a first unit and a second unit of a modular unit system, comprising a first part including a housing having an end wall at a proximal end thereof, at least one magnet arranged inside the housing, an endcap attached to the housing at a distal end thereof and a resilient biasing means arranged over the housing between the end wall and the endcap, the magnetic connector further including a second part having a housing and at least one magnet arranged inside the housing, whereby the resilient biasing means is adapted in use to bias the housing and endcap of the first part in a first retracted position relative to the second part and to contract under a magnetic force emitted by the second part to cause the housing and endcap of the first part to move to a second extended position relative to the second part for engagement therewith.

BRIEF DESCRIPTION OF DRAWINGS

A preferred embodiment of the present invention will now be described, by way of an example only, with reference to the accompanying drawings wherein.

DESCRIPTION OF EMBODIMENTS

The figures show an embodiment of a connectable suitcase 10A, 10B, 10C in accordance with the present invention. The connectable suitcases 10A, 10B, 10C can be of different sizes, or alternatively, may be of the same size. Regardless of the size of the suitcases, the construction of each is the same for the purpose of the present disclosure. The following description refers to the suitcase 10A for ease of reference.

Figure 1:
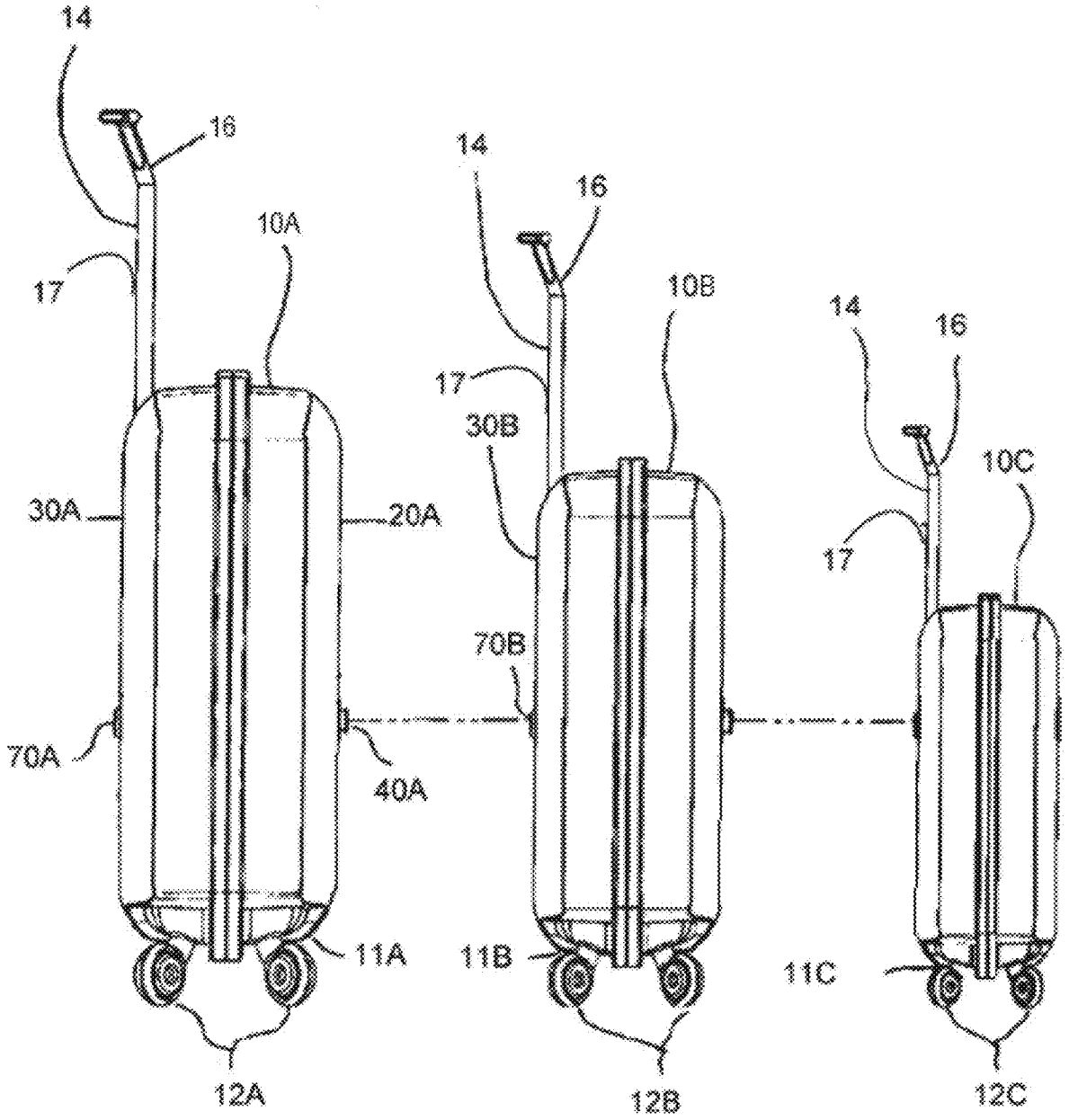
FIG. 1 is a side view of three suitcases in accordance with an embodiment, in which the suitcases are separated from one another.
Figure 2:
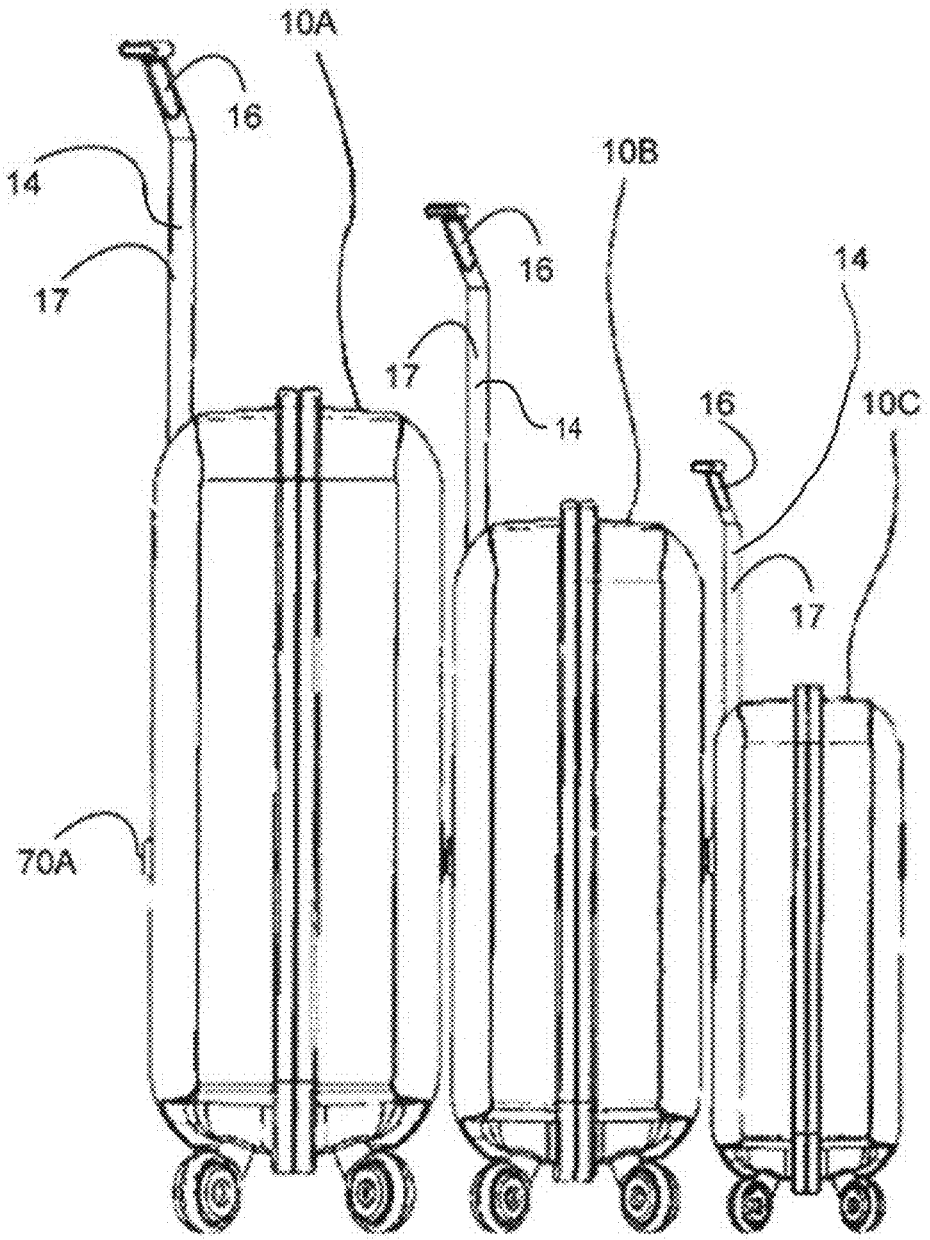
FIG. 2 is a side view of the three suitcases of FIG. 1 in which the suitcases are locked together.
Figure 3:
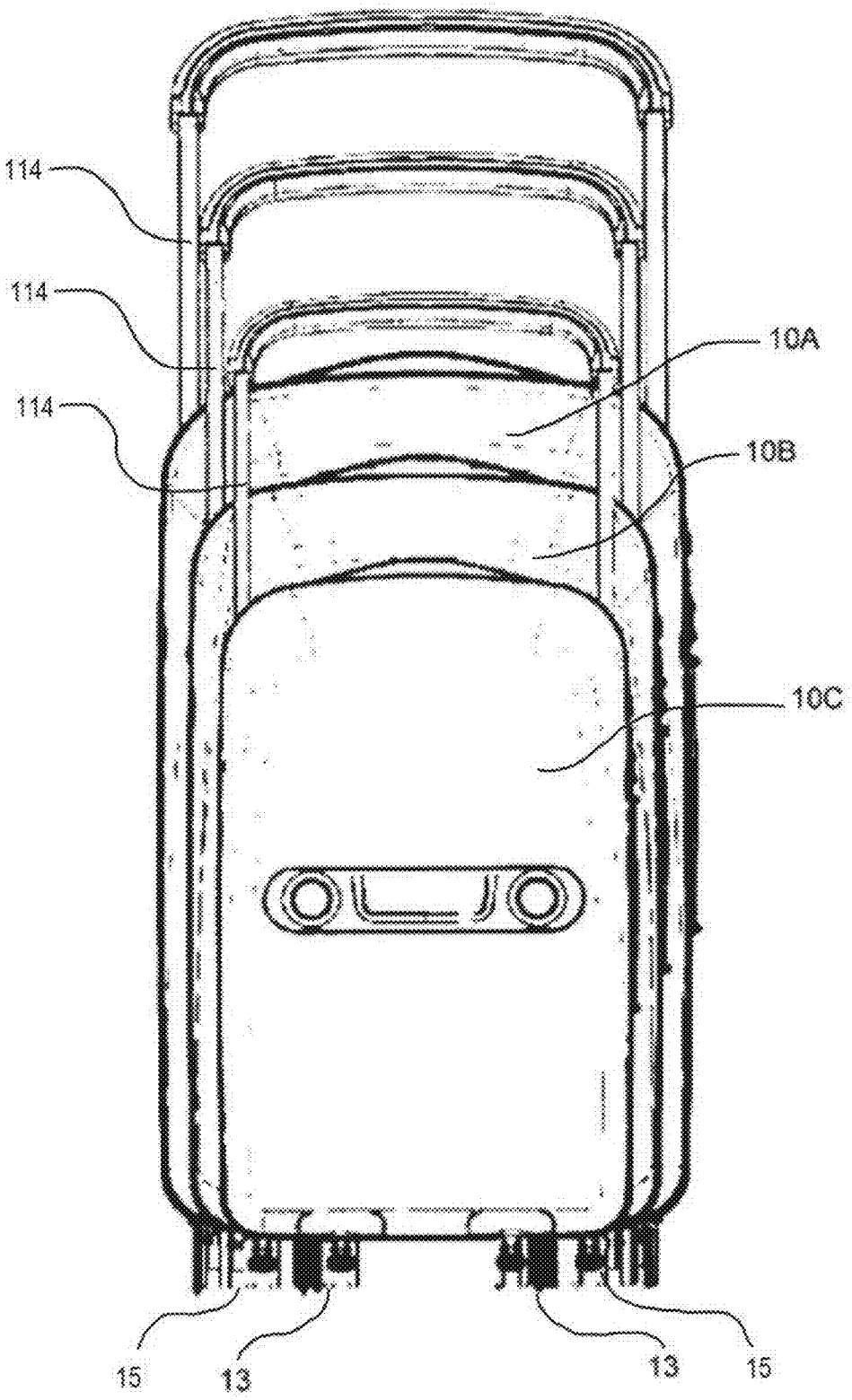
FIG. 3 is a front view of the three suitcases of FIG. 1.
Figure 4:
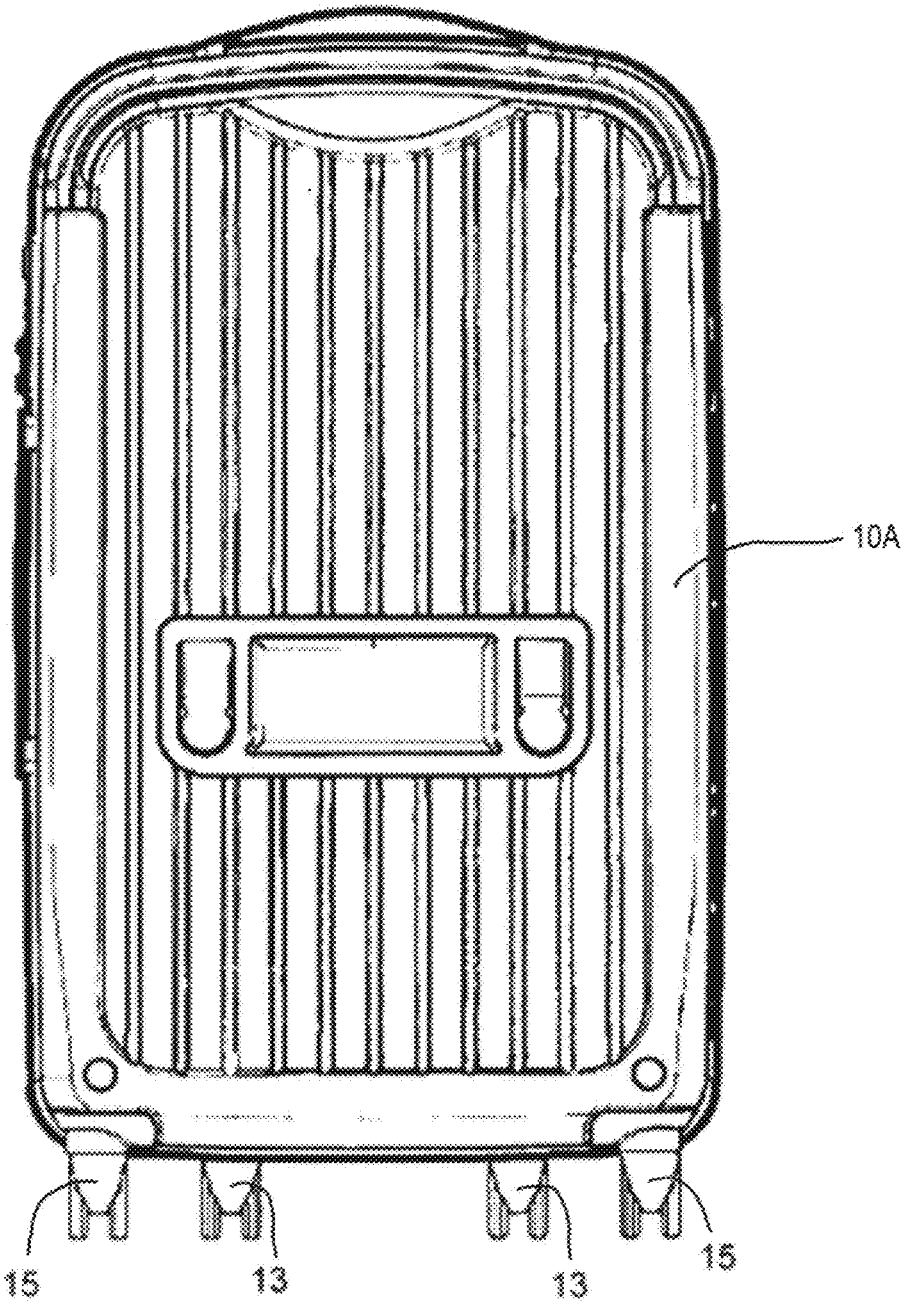
FIG. 4 is a rear view of the suitcase.
Figure 5:
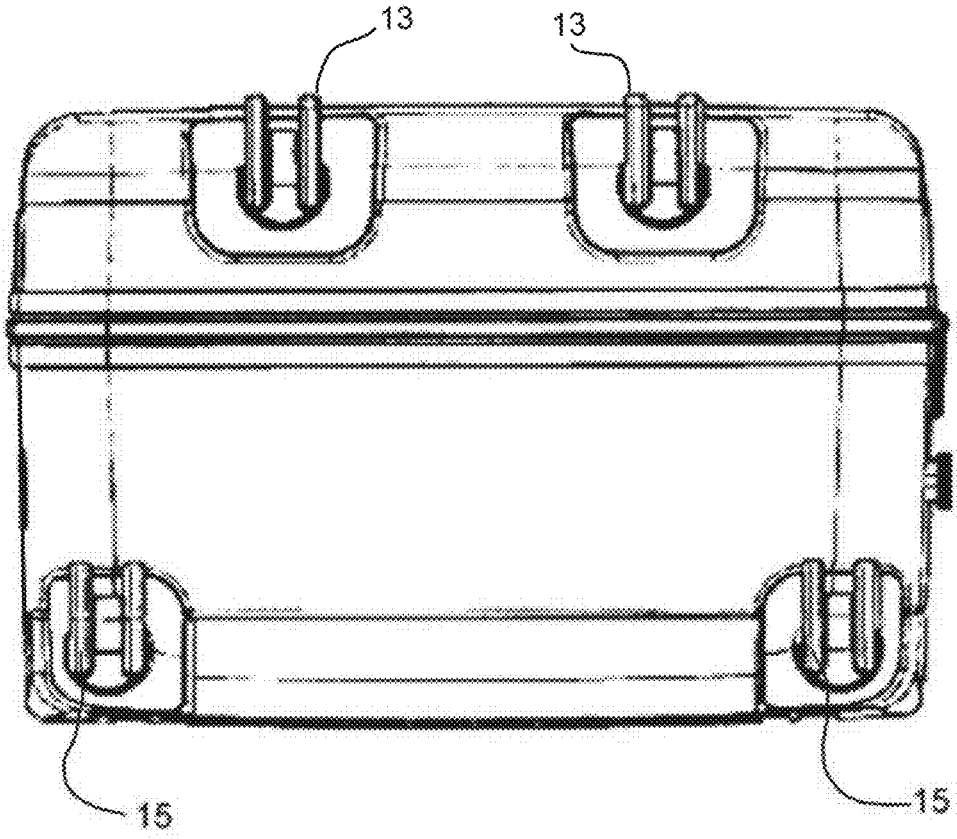
FIG. 5 is a bottom view of the suitcase.

As best seen in FIGS. 1, 2 and 3, each suitcase 10A, 10B, 10C can be connected front to back. Whilst the figures show largest to smallest (10A, 10B, 10C) the suitcases 10A, 10B, 10C may be connected in any order. For example, the larger suitcase 10A may be in front of the medium suitcase 10B, or two (or more) suitcases of the same size may be connected together. The suitcases 10A, 10B, 10C are of the hard shell type and each has a set of wheels 12A, 12B, 12C at a base 11A, 11B, 11C thereof for rolling the suitcases 10A, 10B, 10C on the ground. As can be seen in FIGS. 3, 4 and 5, the front pair of wheels 13 of each suitcase 10A, 10B, 10C are positioned closer to centre than the rear pair of wheels 15. This allows the front pair of wheels 13 of the rear suitcase 10A to nest between the rear pair of wheels 15 of the front suitcase 10B such that the wheels 12 are not inhibited when the suitcases 10A, 10B are connected together, and the suitcases 10A, 10B roll easily. The wheels 12 may be detachable and available in aesthetically pleasing colours such as fluorescent yellow, green or orange.

Each suitcase 10A, 10B, 10C has a retractable handle 14, 114 which can be moved by the user of the suitcase between a retracted position (FIG. 10) and an extended position (FIG. 11) in which the handle 14, 114 can be pulled behind a user such that the suitcase 10A, 10B, 10C can roll over the ground.

FIGS. 1 and 2 show a first embodiment of the retractable handle 14 being a T-shape. The handle 14 includes a first portion 16 and a second portion 17. The second portion 17 is extendable generally vertically from a top portion of the suitcase 10A, 10B, 10C and the first portion extends at an angle rearward of the suitcase 10A, 10B, 10C.

Figure 10:
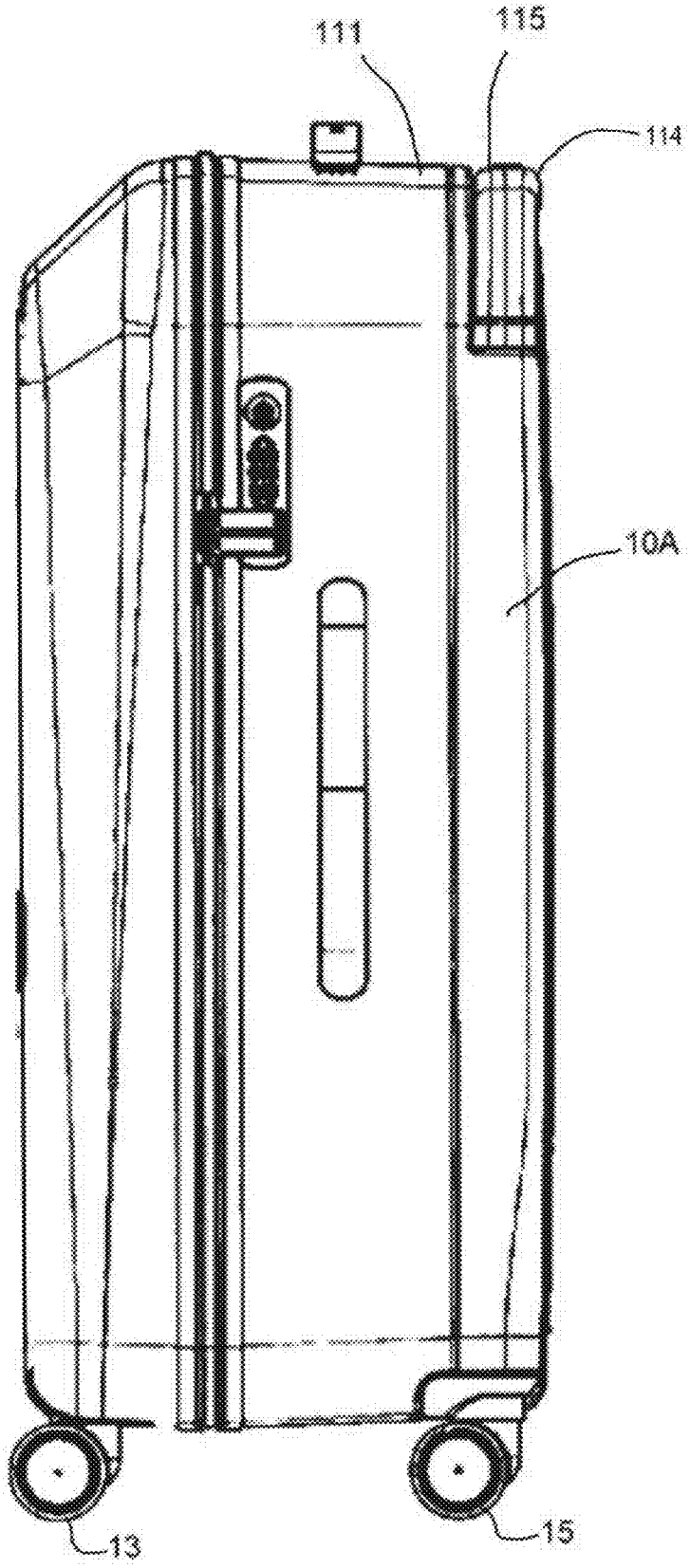
FIG. 10 is a side view of the suitcase with handle stored.
Figure 11:
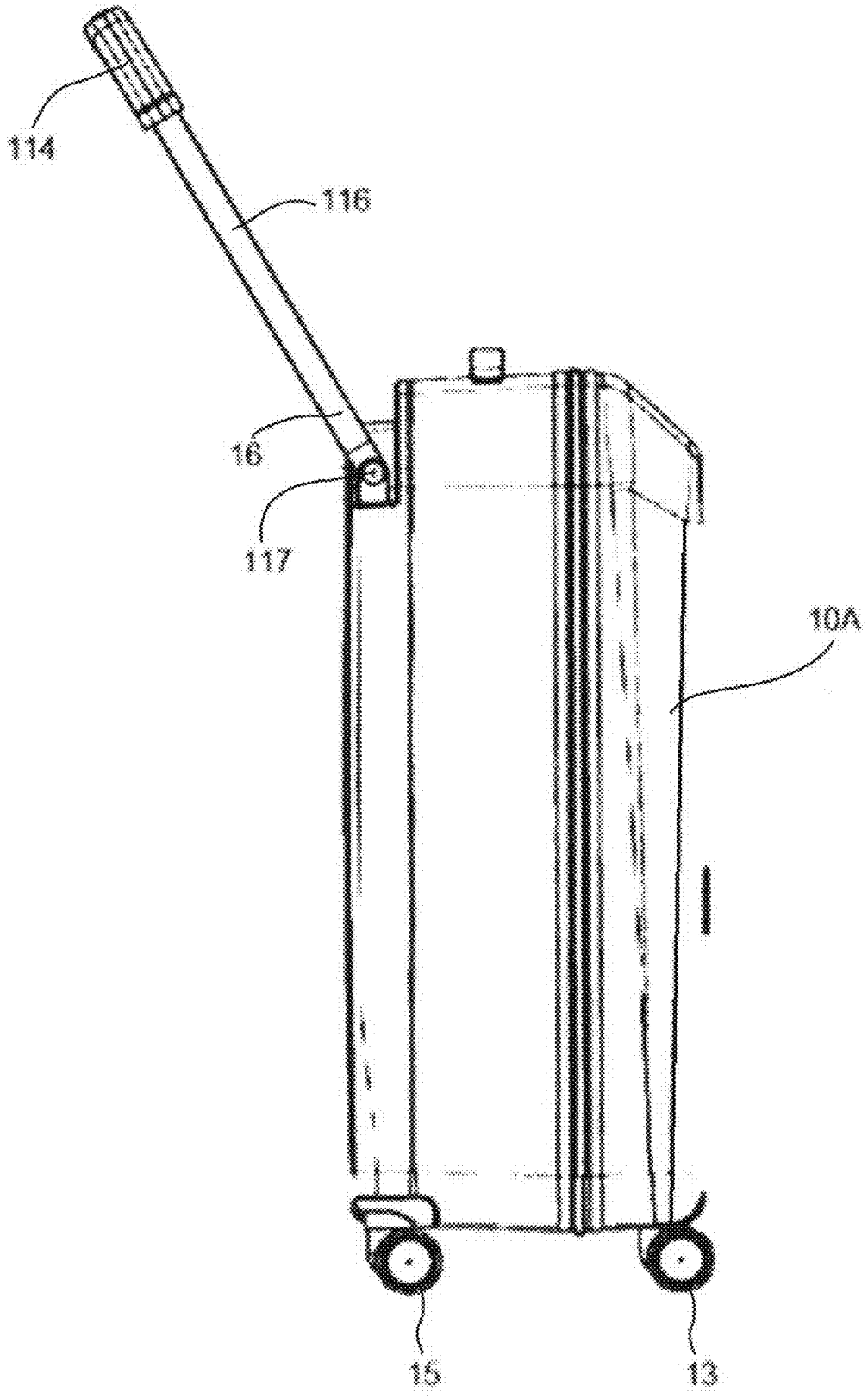
FIG. 11 is a side view of the suitcase with handle extended.
Figure 12:
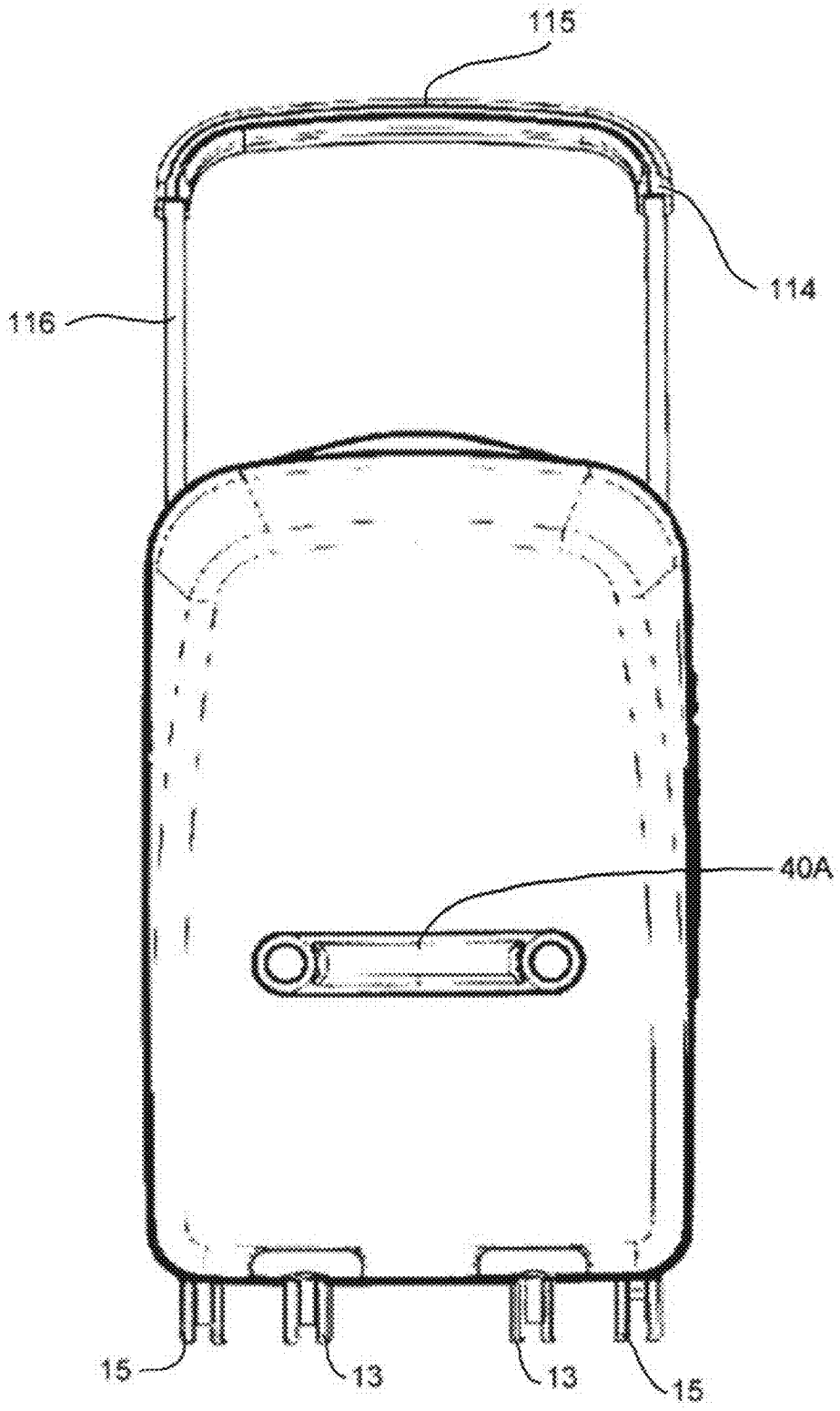
FIG. 12 is a front view of the suitcase with handle extended.

A more preferred embodiment of the retractable handle 114 is shown in FIGS. 3, 10, 11 and 12. FIG. 3 shows the handle 114 extended and FIG. 4 shows a rear view of a suitcase 10A with the handle 114 retracted. As seen in FIG. 12, the handle 14 is generally 'U' shaped, having a pair of telescopic side arms 116 and a central gripping portion 115 the spans the width of the suitcase 10A. Each side arm 116 is pivotably at each end 117 and is pivotable between a generally vertical position for retraction within the suitcase 10A, and an angled position (FIG. 11) to allow both pairs of wheels 13, 15 to remain in contact with ground for ease of movement, and there is no need for a user to tilt the suitcase 10A to roll it along the ground. Both the front pair 13 and the rear pair 15 of wheels remain on the ground as the suitcase is pulled over the ground. When the handle 114 is in the retracted position as shown in FIG. 10, the telescopic arms 116 are retracted such that the central gripping portion 115 lies flush with an upper surface 111 of the suitcase 10A. When in the extended position as seen in FIGS. 11 and 12, the telescopic arms 116 are fully extended in an upright position. The telescopic arms 116 each include a pivotable hinge 117 at a base thereof. The pivotable hinge 117 allows the handle 114 to be tilted away from the suitcase 10A so that the user can comfortably pull it without having to tilt the suitcase 10A. The wide handle design of this embodiment provides lateral stability to the suitcase that allows multiple connected suitcases to be transported together as a unit without over-stressing the handle mechanism.

Referring to FIG. 1, the suitcase 10A has a front surface 20A and a rear surface 30A. The front surface 20A has a first connecting portion 40A and the rear surface 30A has a second connecting portion 70A. As shown in FIG. 2, the first connecting portion 40A of the suitcase 10A will connect with the second connecting portion 70A of a like suitcase 10 to form a single unit for transport. The connection portions 40A and 70A are positioned on the suitcase 10A such that the order of the suitcases is not essential. For example, a larger suitcase 10A may be connected in front of a medium suitcase 10B or vice versa.

Figures 6, 7:
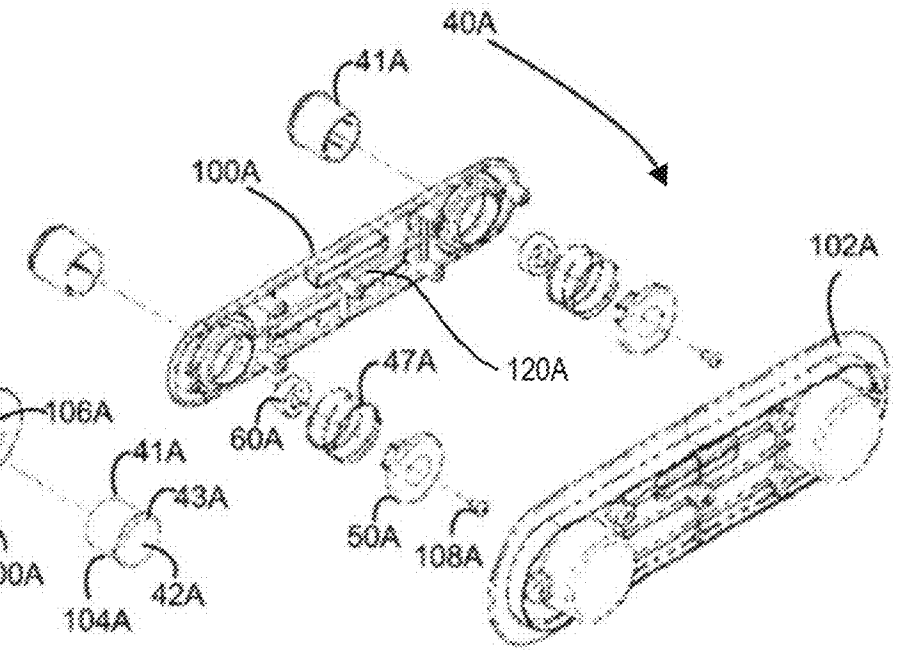
FIG. 6 is an exploded front view of a first connecting portion.
FIG. 7 is an exploded rear view of the first connecting portion.

FIGS. 6 and 7 show exploded front and rear views respectively of a first connecting portion 40A. The first connecting portion 40A includes a locking plate 102A mountable to an inner surface of the suitcase 10A and a bracing plate 100A mountable on an outer surface of the suitcase 10A. The locking plate 102A and the bracing plate 100A are joined together via fasteners (not shown) such as screws to sandwich the front surface 20A of the suitcase 10A therebetween and to house the connecting components described below.

The first connecting portion 40A includes a lock plug 104A being a tubular housing 41A having an end wall 42A at a distal end thereof having a slightly larger diameter than that of the housing 41A to create a flange 43A. Ring magnet 60A and compression spring 117A are positioned using retainer 50A. Retainer 50A includes a circular base 110A circumscribed by a rim 112A and a conical arm 114A extending from the base 110A. Ribs 116A extend from the base 110A along the arm 114A terminating at a top surface of the arm 116A. The arm 114A includes a threaded aperture 118A. Retainer 50A locates the spring 117A inside the rim 112A and prevents lateral movement of the spring 47A. Retainer 50A also keeps the magnet 60A positioned. A circular rim 117A located on the top surface of the arm 116A has a diameter slightly smaller than the inner diameter of the ring magnet 60A and abuts within the inner diameter to securely position the magnet 60A in place.

To assemble the first connecting portion 40A, the tubular housing 41A is fed through the aperture 106A in the bracing plate 100A, and the magnet 60A and the spring 117A are assembled within the tubular housing 41A. The arm 114A of the retainer 50A is inserted through the spring 47A and is used to locate the magnet 60A so that it abuts the end wall 42A of the cover 104A. A self-tapping screw 108A secures the retainer 50A to the tubular housing 41A. The bracing plate 100A includes a reinforcement rib 120A extending between each magnetic assembly 122A allowing the bracing plate 100A to be load bearing thus taking load away from each magnetic assembly 122A. The bracing plate 100A and locking plate 102A allow for ease of assembly and ensure correct alignment during the closing action.

The compression spring 47A is biased in a rest position at which the cover 104A is in a retracted position in which the proximal end 17 of the tubular housing 41A and the endcap 48A protrude into the front surface 20A of the suitcase 10A and the end wall 42A lies flush with the front surface 20A. Under the influence of a sufficiently strong magnetic force applied to the ring magnet 60A, the ring magnet 60A forces the end wall 42A distally into an extended position, overcoming the spring force of the compression spring 47A and contracting the spring 47A.

Figure 9:
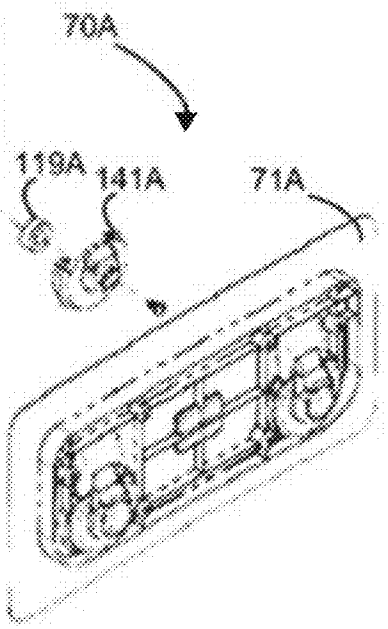
FIG. 9 is an exploded rear view of the second connecting portion.
Figure 8:
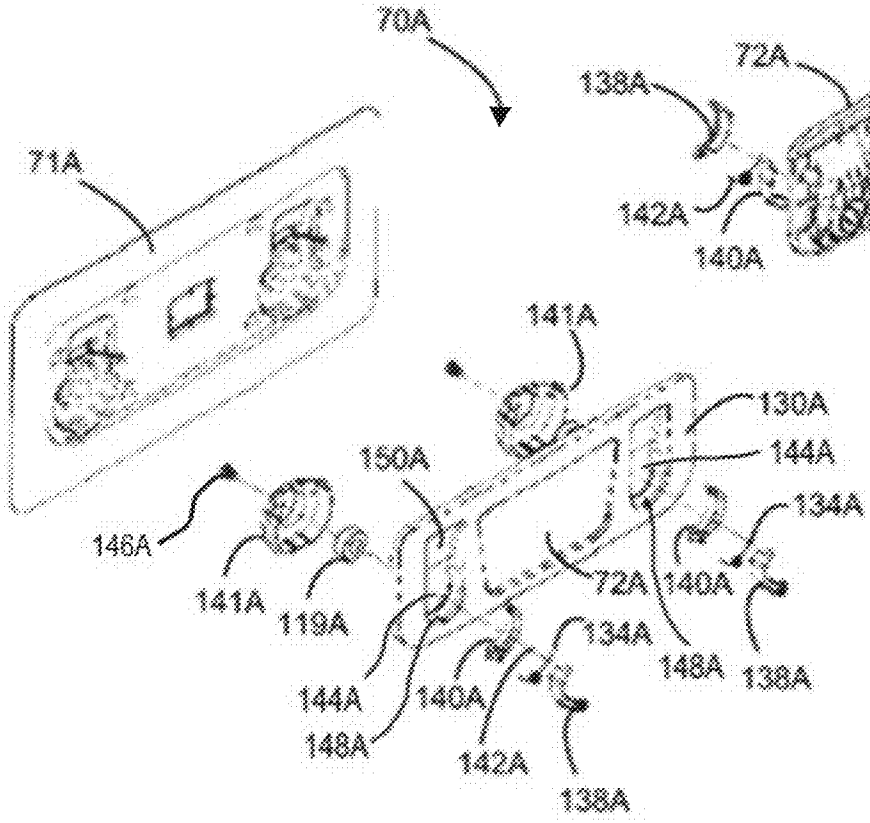
FIG. 8 is an exploded front view of the second connecting portion.

FIGS. 8 and 9 show front and rear views, respectively, of the second connecting portion 70A. The second connecting portion 70A includes a brace plate 71A and a face plate 130A. The brace plate 71A and the face plate 130A cooperate to sandwich a rear surface of the suitcase 10A in a similar manner to the first connecting portion 40A. The brace plate 71A and the face plate 130A house a pair of second magnetic assemblies 119A. The face plate 130A has a sunken central recess 72A and two side recesses 144A. Each side recess 144A is adapted to receive a respective cover (not shown) of the first connecting portion 70A. Each side recess 144A is generally rectangular shaped with a bottom curved portion 148A for receiving the cover. A ramp section 150A facilitates a smooth motion when connecting to another suitcase 10.

The brace plate 71A is adapted to be installed at an interior side of the rear surface 30A of the suitcase 10A, and the face plate 130A is adapted to be installed at an exterior side of the rear surface 30A so that assembled the two plates 71A, 130A sandwich the rear surface 30A of the suitcase 10A. A spring locking element 134A is attached within each recess 144A of the face plate 130A. The spring locking element 134A includes a first arm 138A and a second arm 140A which are snap fit together. A torsion spring 142A sits inside the assembled arms 138A, 140A to urge the arms 138A, 140A together. The spring locking element 134A flexes open to receive the tubular housing 41A of the first connection portion 40A and the torsion spring 142A urges the arms 138A, 140A closed to lock the tubular housing 41A in position. The spring locking element 134A provides positive feedback of locking and requires minimal effort to connect. As best seen in FIG. 8, a screw is used to attach a rear housing 141A and ring magnet 119A to the face plate 130A. Fixing holes and fasteners (not shown) are used to attach the face plate 130A to the brace plate 71A.

Figure 13:
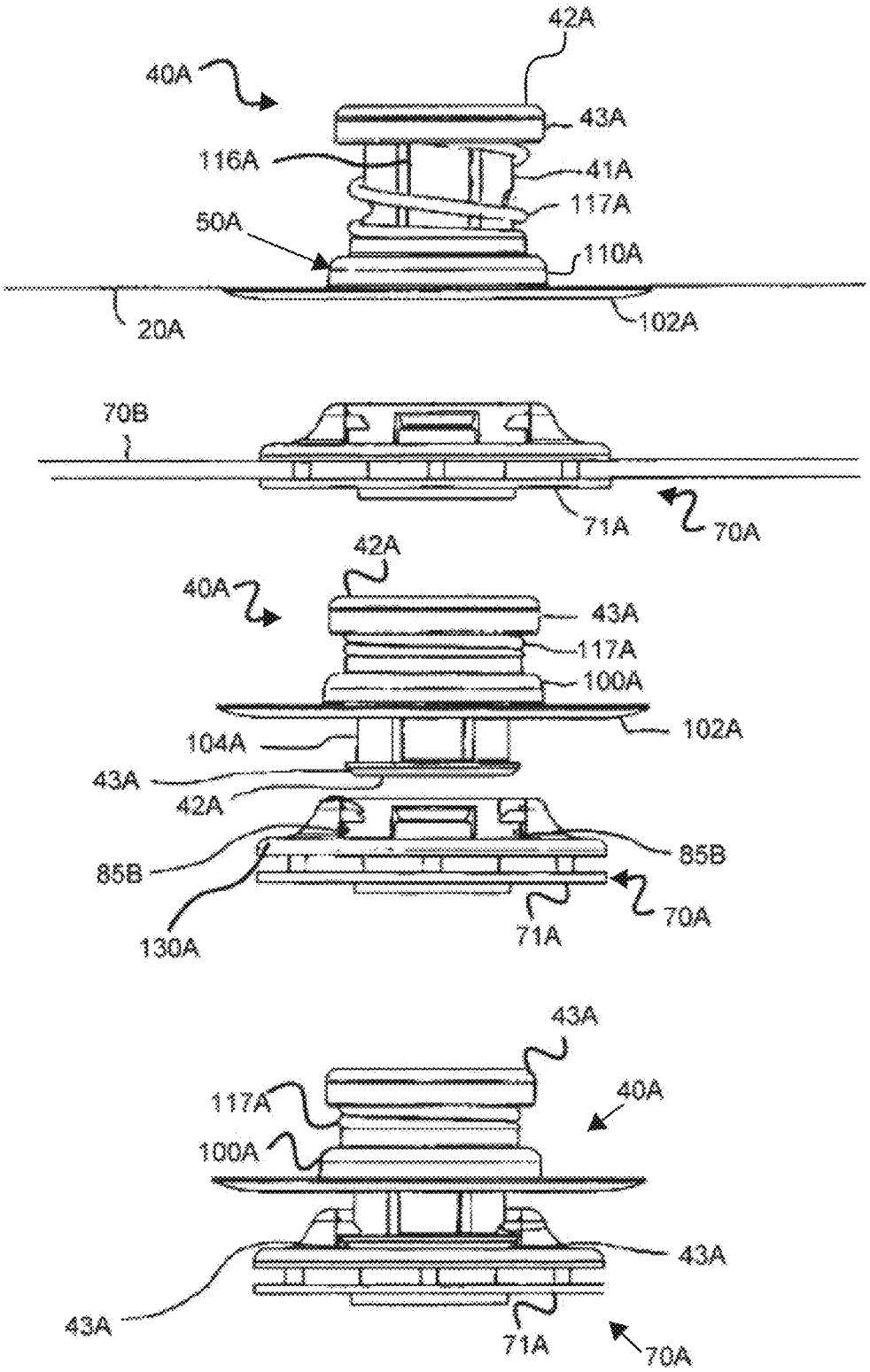
FIG. 13 shows a the engagement process of a first magnetic assembly and a second magnetic assembly.
Figure 14:
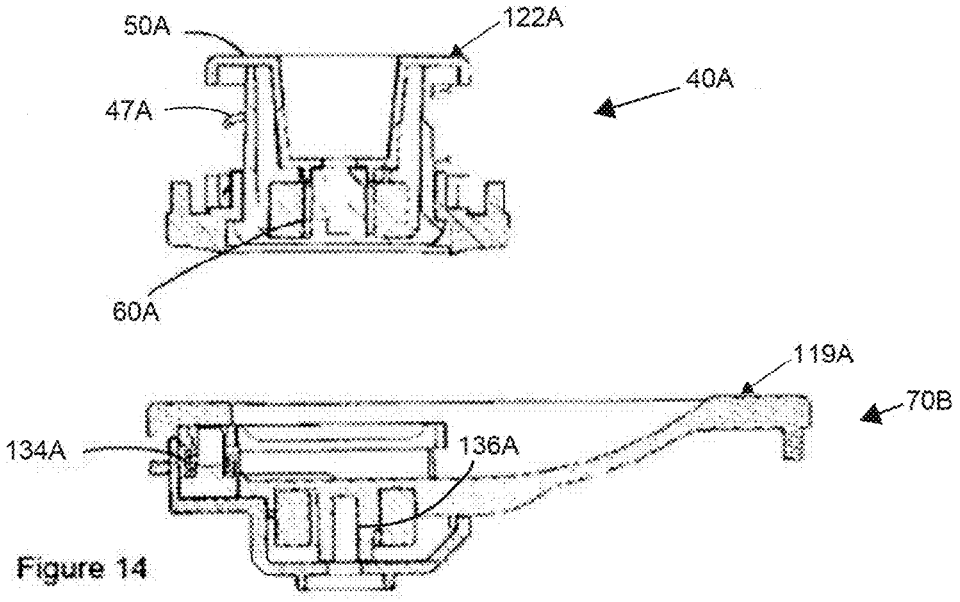
FIG. 14 shows a sectional view of a first magnetic assembly and a second magnetic assembly disengaged.
Figure 15:
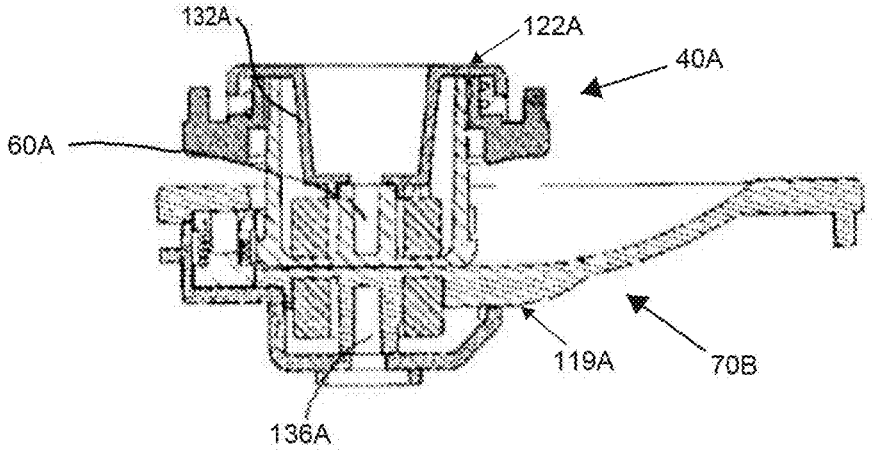
FIG. 15 shows a sectional view of the first connecting portion and the second connecting portion engaged.

Referring now to FIGS. 13, 14 and 15, the suitcases 10A and 10B of FIG. 1 are connected by the magnetic connector as follows.

The first connecting portion 40A is installed in a front surface 20A of a suitcase 10A as seen in FIG. 12. The second connecting portion 70B is installed in a rear surface 30B of a suitcase 10B as seen in FIG. 4.

When it is desired to connect two suitcases 10A, 10B together for transportation, the front surface 20A of suitcase 10A is brought into close proximity with the rear surface 70B of suitcase 10B. The first connecting portion 40A of the connector and the second connecting portion 70B of the connector are installed at the same height above the bases 11A, 11B of the suitcases 10A, 10B such that they line up with one another when the suitcases 10A, 10B are placed next to one another as shown schematically in FIG. 13 and FIG. 14.

The magnets 60A and 136A are of opposite magnetic poles such that they attract one another in close proximity.

FIG. 13 shows the first magnetic assembly 122A and the second magnetic assembly 119A of the magnetic connector disengaged. The first magnetic assembly 122A includes a spring driven retracting plug or cover with a locking piece (undercut) 104A and one magnet 60A and magnet retainer 50A. The second magnetic assembly 119A includes a spring locking element 134A, a magnet 136A and a magnet retainer 132A. FIG. 14 shows the first magnetic assembly 122A and the second magnetic assembly 119A. The connecting portions 40A, 70A are located by magnetic attraction and secured by mechanical fastening. Positioning the connections portions 40A, 70A in close proximity results in the cover 104A from connection portion 40A advancing toward the second connecting portion 70A. The spring locking element 134A from the second connecting portion 70A deflects to allow the cover 104A from the first connecting portion 40A to pass through and enter the locked position. The torsion spring 142A allows the spring locking element 134A to flex open and then close as the lock plug 104A enters the locking position. This provides good feedback and less effort to connect the suitcases 10.

To disengage the suitcase 10A from the suitcase 10B, the suitcase 10A is lifted vertically by a small amount to disengage the magnets 122A, 119A. Ramp 150A provides for a smooth unlocking motion.

It will be readily apparent that several suitcases can be locked together in this manner for transportation together such that no luggage trolley is required.

The magnetic connector may be used to lock together other units such as soft shell suitcases, golf bags or other sporting equipment bags or storage units.

Other types of magnets may be used as appropriate.

In an alternative embodiment of the suitcase, the connector is a quick-release connector or latch mechanism.

Although the invention has been described with reference to specific examples, it will be appreciated by those skilled in the art that the invention may be embodied in many other forms.

The invention claimed is:

1. A suitcase connectable to another suitcase, the suitcase including:

a first connecting portion disposed on a front surface of the suitcase, the first connecting portion includes a bracing plate mountable to an outer surface of the front surface of the suitcase, a locking plate mountable to an inner surface of the front surface of the suitcase, and a lock plug, the bracing plate and the locking plate being connectable together with the front surface of the suitcase therebetween, the lock plug being coupled to the bracing plate such that the lock plug is slidable between a retracted position and an extended position within an aperture defined by the bracing plate, an end wall of the lock plug being flush with front surface of the suitcase to which the bracing plate is mountable when in the retracted position, and the end wall of the lock plug extending outwardly from the front surface of the suitcase when in the extended position;

a second connecting portion disposed on a rear surface of the suitcase;

a front pair of wheels mounted along a first axis, the front pair of wheels being spaced apart laterally by a first distance along the first axis; and a rear pair of wheels mounted along a second axis parallel to the first axis, the rear pair of wheels being spaced apart laterally by a second distance along the second axis, the second distance being larger than the first distance, wherein the first connecting portion is operatively connectable by the lock plug to a further second connecting portion disposed on a rear surface of another suitcase such that the front pair of wheels of the suitcase nest between a rear pair of wheels of the other suitcase.

2. The suitcase of claim 1, wherein the first connecting portion includes a ring magnet and the second connecting portion includes a complementary ring magnet, the ring magnet being attracted to a further complementary ring magnet of a further second connecting portion disposed on a rear surface of another suitcase.

3. The suitcase of claim 1, further including a handle movable between a retracted position and an extended position, wherein the handle is pivotably connected to the suitcase so that in the extended position the handle is pivotable to an angle relative to the suitcase.

4. The suitcase of claim 3, wherein the handle is pivotable away from the suitcase to allow both the front and rear pairs of wheels to engage ground while moving.

5. The suitcase of claim 3, wherein the handle includes a pair of telescopic arms pivotable hinged to the suitcase.

6. The suitcase of claim 1, wherein the second connecting portion includes a spring locking element biased to engage a portion of a first connecting portion disposed on a front surface of an additional suitcase.

7. The suitcase of claim 1, wherein the bracing plate includes a reinforcement rib.

8. The suitcase of claim 7, wherein the first connecting portion further includes a second lock plug, the second lock plug being coupled to the bracing plate such that the second lock plug is slidable within a second aperture defined by the bracing plate, the first connecting portion being operatively connectable by the second lock plug to a respective further second connecting portion disposed on a rear surface of another suitcase, wherein the reinforcing rib extends between the lock plug and the second lock plug.

* * * * *